US005245958A

United States Patent [19]

Krieg et al.

[11] Patent Number: 5,245,958

[45] Date of Patent: * Sep. 21, 1993

[54] DIRECT ACTING HYDRAULIC VALVE LIFTER

[75] Inventors: John J. Krieg, Spencerport; Lucille A. E. Gotham; Wayne S. Harris, both of Rochester, all of N.Y.

[73] Assignee: General Motors Corporation, Detroit, Mich.

[ * ] Notice: The portion of the term of this patent subsequent to Jun. 9, 2009 has been disclaimed.

[21] Appl. No.: 895,471

[22] Filed: Jun. 8, 1992

Related U.S. Application Data

[63] Continuation of Ser. No. 610,254, Nov. 8, 1990, Pat. No. 5,119,774.

[51] Int. Cl.[5] ..... F01L 1/14

[52] U.S. Cl. ..... 123/90.55; 123/90.57

[58] Field of Search ..... 123/90.48, 90.55, 90.56, 123/90.57

[56] References Cited

U.S. PATENT DOCUMENTS

| | | | |
|---|---|---|---|
| Re. 32,167 | 6/1986 | Buente | 123/90.55 |
| 3,304,925 | 2/1967 | Rhoads | 123/90.55 |
| 3,921,609 | 11/1975 | Rhoads | 123/90.55 |
| 4,184,464 | 1/1980 | Svihlik | 123/90.55 |
| 4,465,038 | 8/1984 | Speil | 123/90.55 |
| 4,483,281 | 11/1984 | Black | 123/90.55 |
| 4,579,094 | 4/1986 | Doppling et al. | 123/90.55 |
| 4,584,976 | 4/1986 | Hillebrand | 123/90.55 |
| 4,635,593 | 1/1987 | Kodama | 123/90.55 |
| 4,648,360 | 3/1987 | Schaeffler | 123/90.55 |
| 4,745,888 | 5/1988 | Kapp | 123/90.55 |
| 4,756,282 | 7/1988 | Kunz et al. | 123/90.55 |
| 4,782,799 | 11/1988 | Goppelt et al. | 123/90.55 |
| 4,787,347 | 11/1988 | Schaeffler | 123/90.55 |
| 4,802,448 | 2/1989 | Albeitner | 123/90.55 |
| 4,825,823 | 5/1989 | Schaeffler | 123/90.55 |
| 4,867,114 | 9/1989 | Schaeffler | 123/90.55 |
| 5,081,976 | 1/1992 | Dahm et al. | 123/90.55 |
| 5,107,806 | 4/1992 | Dohring et al. | 123/90.55 |
| 5,129,372 | 7/1992 | Seiberth et al. | 123/90.55 |

FOREIGN PATENT DOCUMENTS

| | | | |
|---|---|---|---|
| 3529446 | 2/1987 | Fed. Rep. of Germany | 123/90.55 |

OTHER PUBLICATIONS

"Development of Improved Hydraulic Valve Lifters for AUDI/VW Engines" Hans Will, Ernst Jan a und Fritz Naumann, MTZ Motortechnishe Zeitschrift 48 (1987) 5, pp. 195 and 197 (with translations pages numbered 1-6) (See FIG. 7).

*Primary Examiner*—Noah P. Kamen
*Attorney, Agent, or Firm*—Robert J. Outland

[57] ABSTRACT

An improved direct acting hydraulic valve lifter (DAHVL) has features including reduced dead oil storage with lower mass and faster filling, improved air venting, internal oil recirculation and targeted oil supply that combine to reduce the presence of air in the lifter. Foam filling and baffle reconfiguration are included among means for reducing stored oil volume which can also improve the follower cylinder support. Means for venting along the piston and cylinder of the lifter are shown. The various features combine to limit air intake and to more quickly expel air which does enter the lifter.

17 Claims, 5 Drawing Sheets

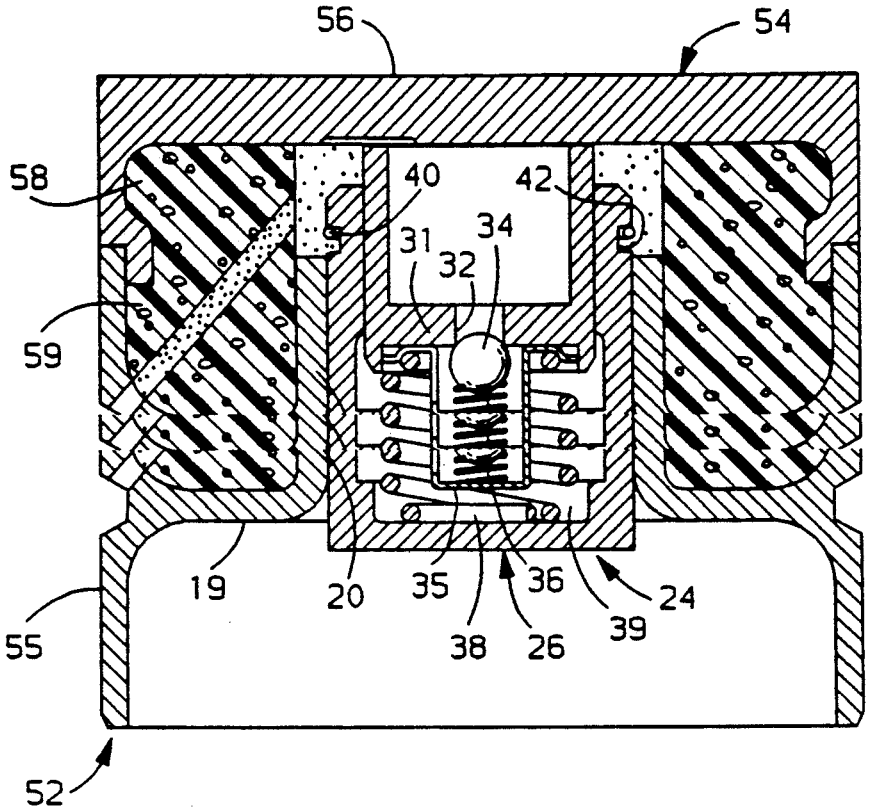
FIG. 3
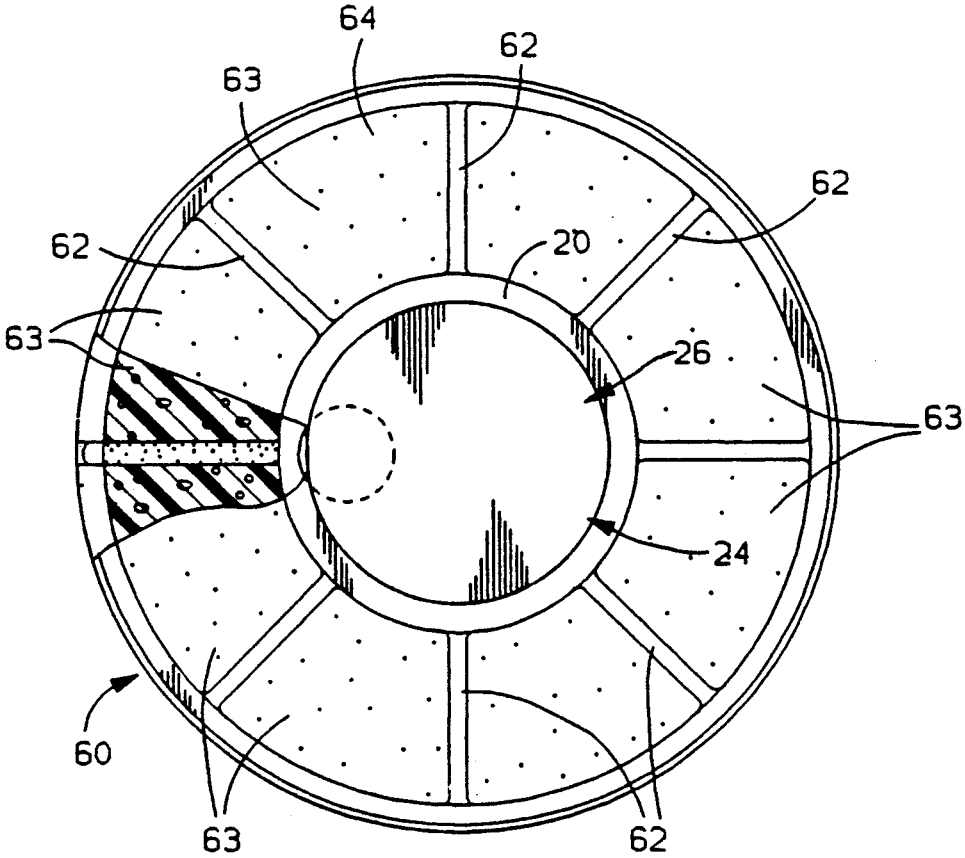

DIRECT ACTING HYDRAULIC VALVE LIFTER

CROSS REFERENCE

This is a continuation of U.S. patent application Ser. No. 07/610,254 filed Nov. 8, 1990 and now U.S. Pat. No. 5,119,774 granted Jun. 9, 1992 to the assignee of the present invention.

TECHNICAL FIELD

This invention relates to hydraulic valve lifters (HVL's) for engines and, in more particular embodiments, to direct acting HVL's of light weight for use in relatively high speed overhead cam (OHC) automotive engines and the like. HVL's may also be referred to as hydraulic tappets and sometimes are called hydraulic lash adjusters, and direct acting hydraulic valve lifters (DAHVL's) are sometimes called bucket tappets, however these various names are not necessarily of equivalent scope.

BACKGROUND

It is known in the art relating to overhead cam (OHC) internal combustion engines to provide a direct acting hydraulic valve lifter (DAHVL) that is contacted by a cam and directly actuates one or more valves of the engine. One such arrangement which has been used in production engines is shown in U.S. Pat. No. 4,745,888 issued May 24, 1988 to the assignee of the present invention.

In this patent disclosure, a camshaft 18 supported in an aluminum camshaft carrier 11 has cams 22, each of which directly engages a DAHVL (tappet 23) that in turn engages the stem 34 of a poppet valve conventionally carried in a cylinder head, not shown, to actuate the valve. Each lifter 23 includes a cup-like follower having a cam engaging alloy cast iron upper end 24 diffusion bonded to a cold formed steel baffle shell including an annular outer wall (skirt 26) and an inwardly supported central wall 27. The central wall includes a radial supporting baffle and an axial annular cylinder portion in which a hydraulic element assembly (HEA) (hydraulic lash adjuster 28) is reciprocably supported. The HEA is supplied with hydraulic fluid (engine oil) through an annular oil feed chamber 30 which is fed at its lower edge through an opening 32 via an external groove 31.

The follower construction is thin-walled to maintain a low reciprocating weight for the lifter 23 as is desirable for operation at higher engine speeds. However, the chamber 30 is filled with a significant volume of oil which increases the reciprocating mass of the lifter in operation. Also, the oil in the chamber 30 may drain from the lifter when the engine is stopped so that, upon starting, the oil supply must again fill the chamber 30 before a dependable feed of oil is again provided to the HEA 28. During this period, the HEA must rely upon an internal oil reservoir for its oil supply. In addition, air may enter the system such as through draining of the chamber 30 when the engine is stopped or foaming of the oil supply during engine operation. This air may enter the HEA through an inlet from the chamber 30, resulting in unwanted tappet noise and/or improper valve actuation for an extended period until the air is removed from the lifter by escape through the clearances apart from or along with the escaping oil.

SUMMARY OF THE INVENTION

The present invention provides an improved direct acting hydraulic valve lifter (DAHVL) having various features which individually and/or in combination may provide reduced reciprocating mass with lower oil loss in operation, faster filling of the lifter after draining and more positive discharge of air from the lifter. These results are obtained by providing one or more of the following features:

- Reduced oil storage volume such as through filling of the annular oil space with foam or other filler or by reshaping the baffle to reduce or eliminate this space;
- Means targeting the oil inlet passage to aim at and preferentially deliver oil to the inlet of the HEA;
- Recirculation means in the HEA to recirculate oil escaping from its high pressure chamber to the internal reservoir rather than escaping into the annular outer space;
- Vent means from the oil chambers such as through the foot or preferably through passage means between the HEA and the follower cylinder supporting it.
- A preferred embodiment of the invention provides a hydraulic valve lifter in which an annular chamber that forms part of a feed path through a follower to a lash adjusting hydraulic element assembly (HEA) is filled with a low density oil resistant material that displaces the unnecessary or dead volume of oil. The filler reduces the volume which must be filled to provide oil to the HEA and shortens the time to restore normal operation of the system when the lifter is drained. Of course a suitable inlet passage must be provided through the filler. This passage is preferably oriented to aim the incoming stream of oil directly at the inlet to the HEA reservoir to promote fast filling thereof.

The density of the filler must be not greater than the oil which is displaced in order to avoid increasing the reciprocating mass of the lifter. Preferably it will be significantly lighter or less dense than the oil and thus result in a lower reciprocating mass. An oil resistant foam is a suggested material for this purpose. Preferably the foam will have adequate stiffness to provide additional support to the cylinder portion of the central wall that supports the HEA.

If the strength of the filler is sufficient, it may also be possible to reduce the thickness or otherwise lighten the baffle and/or cylinder of the central wall or to eliminate the baffle and support the cylinder solely by the filler. This may further lighten the lifter. An epoxy material is suggested as suitable for such a purpose. Of course any suitable filler material may be used that provides the combination of lightness and strength needed for the particular application.

Preferably, a recirculation orifice in the HEA plunger wall recirculates oil escaping from the high pressure chamber to the inner reservoir before it leaves the surrounding piston. This reduces the inflow of makeup oil from the annular space and lessens the volume of air which may enter the HEA through the HEA inlet.

Additionally, an internal vent is preferably provided from the annular space in the follower to promote the removal of air from the inflowing oil. Any suitable vent means may be employed but a preferred embodiment at present comprises a passage formed between the HEA piston and the cylinder carrying it by means such as a flat or groove on the exterior of the piston, or a groove in the interior of the cylinder. Such a passage may be straight, spiral or of other suitable form and cross section to assist in controlling the flow of air and oil through the vent to a desired amount.

As an alternative to filling the conventional annular chamber to reduce oil volume, the follower baffle may be reconfigured to reduce or eliminate the annular chamber from the interior. A preferred arrangement has a U-shaped annular insert that is fixed within a cup shaped follower to form a baffle extending to the head with an inner portion forming the HEA supporting cylinder.

These and other features and advantages of the invention will be more fully understood from the following description of certain specific embodiments of the invention taken together with the accompanying drawings.

BRIEF DRAWING DESCRIPTION

In the drawings:

FIG. 3 is a cross-sectional view of an alternative embodiment of foam filled DAHVL according to the invention;

FIG. 4 is a bottom view of another embodiment of foam filled DAHVL according to the invention;

Figure 9:
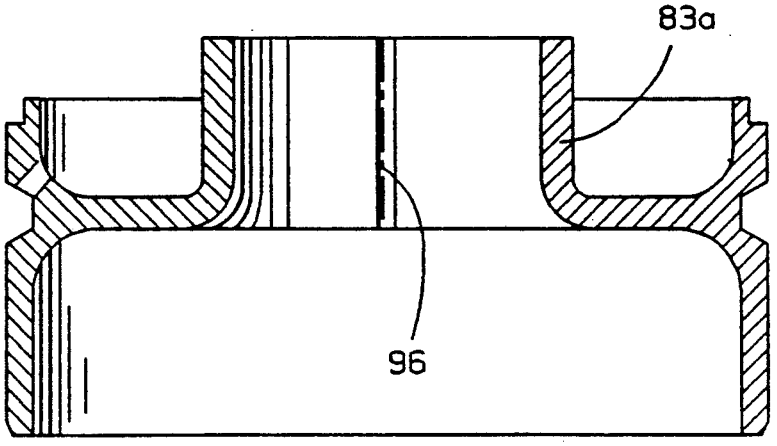
Figure 10:
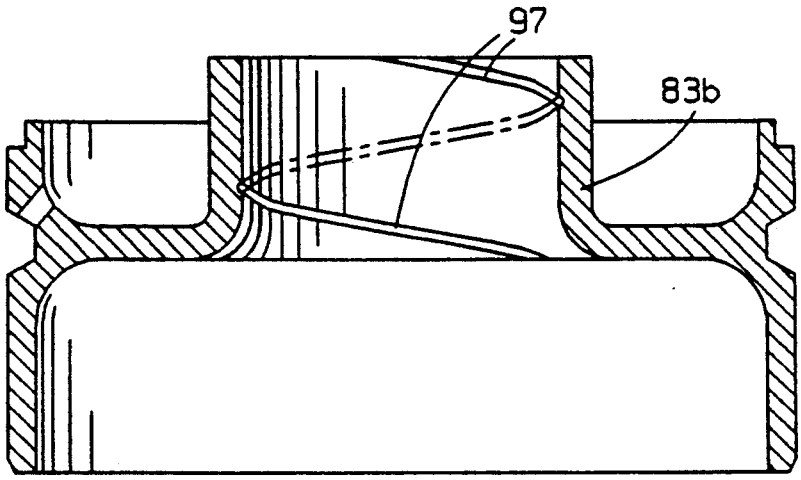
Figure 11:
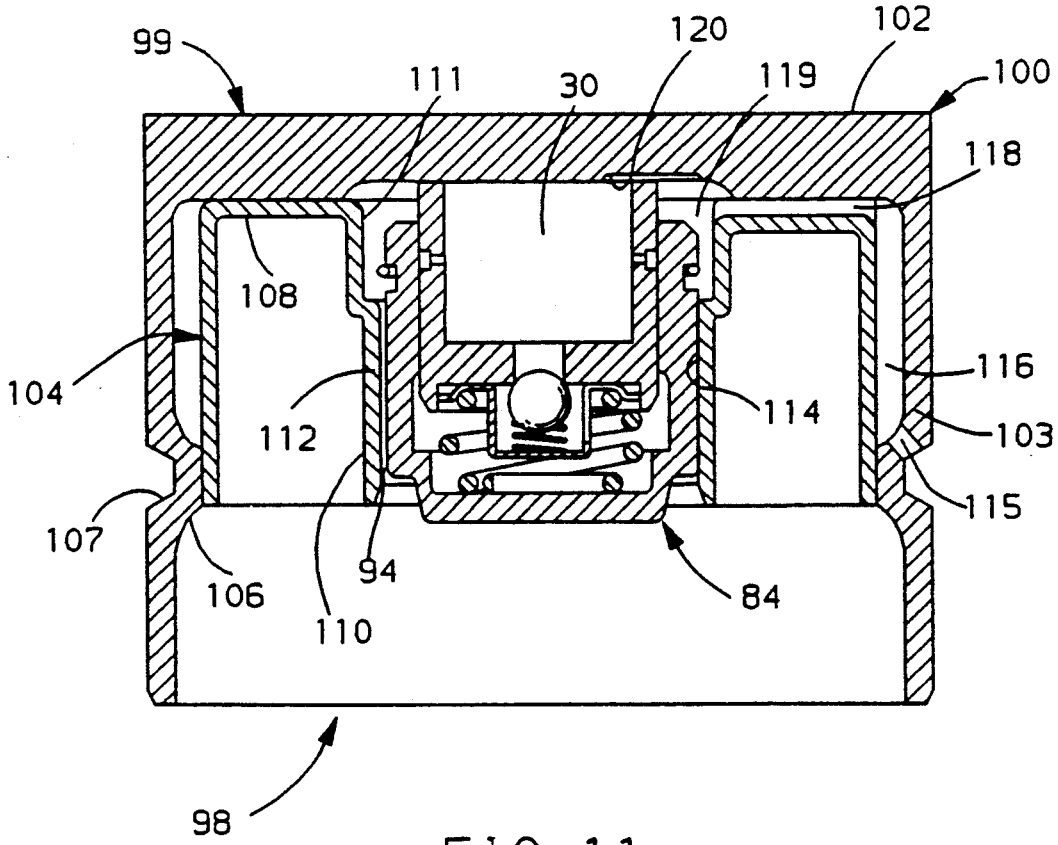

FIG. 9 cross-sectional view of the lower portion of a lifter follower with a straight groove in the cylinder for venting;

FIG. 10 is a cross-sectional view of the lower portion of a lifter follower with a spiral groove in the cylinder for venting; and FIG. 11 is a cross-sectional view of another embodiment of DAHVL with an oil displacing baffle insert and also including targeting, venting and recirculation features;

DETAILED DESCRIPTION

Figure 1:
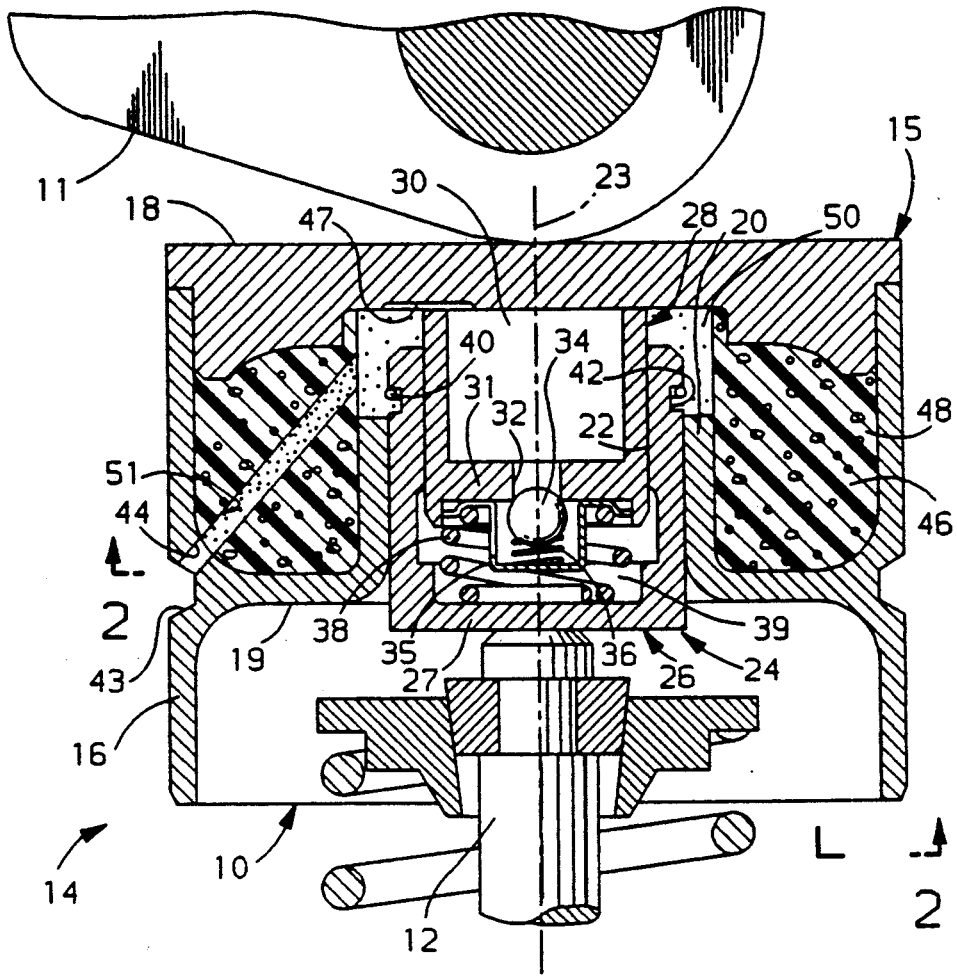
FIG. 1 is a cross-sectional view of a direct acting hydraulic valve lifter (DAHVL) with mass-reducing foam filler and fill targeting according to the invention.
Figure 2:
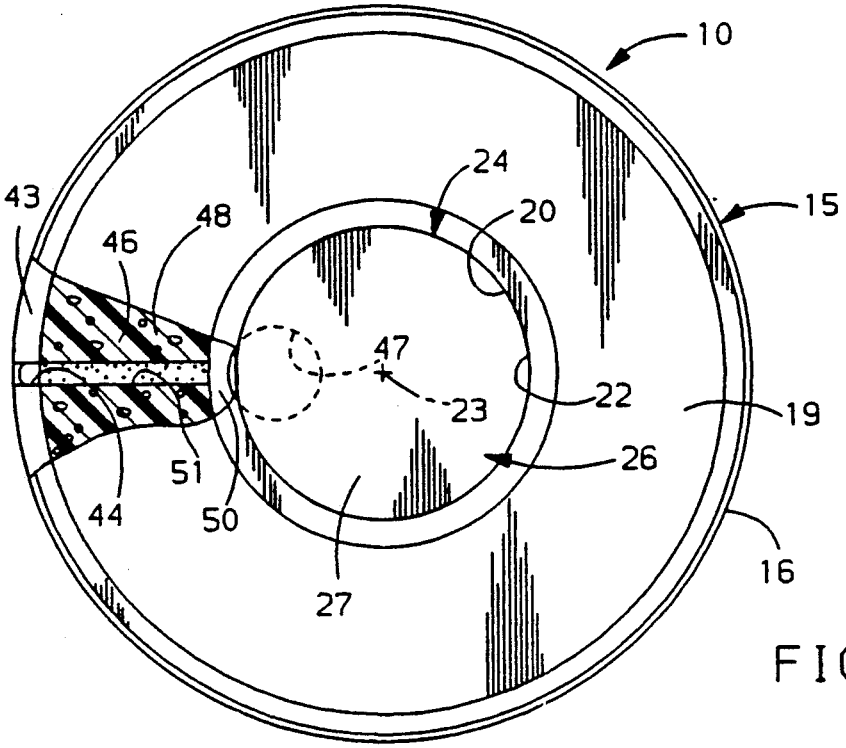
FIG. 2 is a partial cross-sectional view from the plane of the line 2—2 of FIG. 1 showing the filler and inlet passage.

Referring now to FIGS. 1 and 2 of the drawings in detail, numeral 10 generally indicates a preferred embodiment of direct acting hydraulic valve lifter (DAHVL) according to the invention. Lifter 10 has the general construction of the tappet described in the previously cited U.S. Pat. No. 4,745,888 and is adapted to be reciprocably mounted between a cam 11 and the stem 12 of a cylinder poppet valve in an engine 14 in a conventional manner as shown, for example, in the cited patent.

The lifter 10 includes a cup-like follower 15 with an annular skirt or outer wall 16 having an open bottom end and closed at the upper end by a cam-engaging head 18. The head 18 may be conventionally formed of alloy cast iron and diffusion bonded or otherwise connected to the outer wall 16. Integral with the outer wall 16 is a central wall made up of a radial baffle 19 and an axial cylinder 20 extending upward from and supported by the baffle. The cylinder 20 has an inner cylinder surface 22 parallel with an axis 23 of reciprocation and spaced from the head 18 that defines the closed end of the follower.

Within the cylinder is reciprocably carried a conventional hydraulic element assembly (HEA) 24 including a hollow piston 26 guidingly received and reciprocable in the cylinder surface 22 on the axis 23. The piston 26 includes a closed end 27 facing (downwardly) away from the head 18 that defines the closed end of the follower 15. In the engine, the piston closed end 27 engages the stem 12 of an associated valve for opening it in response to downward movement of the follower 15 by the cam 11.

In the conventional HEA illustrated, a plunger 28 is carried with closely controlled clearance within the piston 26 and includes an open topped upper portion defining a reservoir 30. A transverse wall 31 near the bottom of the plunger has a central orifice 32 controlled by a ball check valve 34 conventionally retained in a cage 35 and biased closed by a light spring 36. A plunger spring 38 extends within a high pressure chamber 39 between the wall 31 of the plunger and the closed end 27 of the piston, which define the chamber, to bias the piston and plunger apart and maximize the volume of the chamber 39. A retainer ring 40 in a groove 42 near the top of the piston limits downward travel of the piston so that the spring 38 normally urges the plunger 28 into constant contact with the under side of the follower head 18.

As in the prior construction, the follower has an external annular groove 43 connected with a feed hole 44 through the outer wall 16 for receiving engine oil under pressure from an a gallery, not shown, and delivering the pressurized oil into an annular space 46 defined between the cylinder 20, the outer wall 16, the baffle 19 and the head 18. A recess 47 in the under side of the head 18 allows the oil to pass over the open end of the plunger 28 and into the reservoir 30 from which it is fed into the high pressure chamber 39 to enable the valve lifter to operate in known manner to take up lash in the valve train between the cam 11 and the valve 12.

The portion of the DAHVL 10 so far described does not differ from previously known units in current use in automobile engines and the operation of which is well known so that a detailed description of their operation is not needed.

However, the present invention differs from the prior art units in that the annular space 46 is almost completely filled by a filler 48 which operates to displace the oil that would otherwise fill this space during operation. The filler preferably extends in the follower 15 radially between the outer wall 16 and the cylinder 20 and axially between the head 18 and the baffle 19. A small open annulus 50 is left in the lifter 10 above the upper edges of the cylinder 20 and piston 26 outward of the plunger 28 to provide clearance for the piston retainer ring 40 and to contain a small volume of oil for delivery through the recess 47 to the reservoir 30.

Oil is delivered to the annulus 50 by an inlet passage 51 extending through the filler from the feed hole 44 to the annulus 50. Preferably, the passage 51 is aimed directly at the recess 47 so that the oil is preferentially directed into the reservoir 30 from the targeted inlet passage 51.

The filler may be made of any suitable oil resistant non-absorbent material which can be placed or formed within the space 46. However the filler must have a density no greater than the oil that is replaced thereby in order that the reciprocating mass of the lifter not be increased. The choice of filler material may vary depending upon the strength and density characteristics desired. For example, an epoxy filler may be chosen if high strength to support the cylinder 20 is most important. A lightweight foam may be selected if the main purpose is to reduce the reciprocating mass of the lifter by displacing oil with a lighter weight material. The pores of the foam should be closed in order to prevent absorption of oil which would nullify the mass reduction.

At present, a preferred lightweight foam material which is oil and temperature resistant and can provide at least supplemental support to the cylinder 20 when installed is an isocyanurate modified polyester foam provided by Systeme-Chardonol Division of Cook Composites and Polymers (formerly the Freeman Chemical Company) of Port Washington, Wisconsin. The foam is reportedly made from tradenamed materials with a mix ratio of 100 pbw Chempol ® 030-A792-24 resin to 200 pbw Chempol$_R$ 030-2416 isocyanate.

Alternative Embodiments

Figure 5:
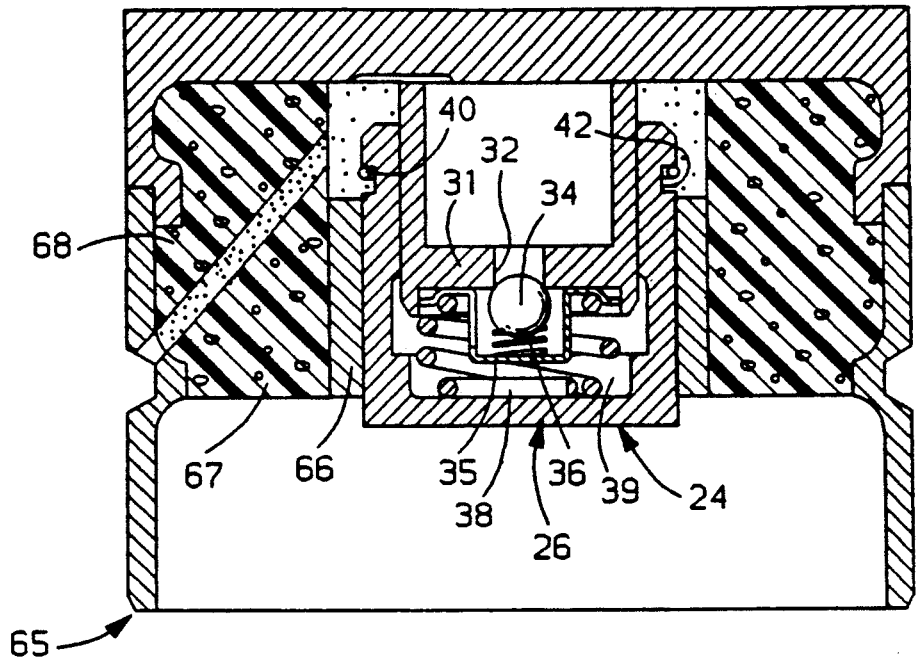
FIG. 5 is a cross-sectional view of still another foam filled embodiment of the invention.

In FIGS. 3-5 are illustrated alternative embodiments of DAHVL's incorporating the features of the invention. Like numerals are used for components which are like those of the first or another embodiment. In each case, the only differences are in the construction of the follower and the resulting shapes of the foam or other filler used in the particular lifter. Thus, the HEA 24 and its components are the same in each of the illustrated embodiments. However, it should be understood that other forms of HEA's or pressure actuated piston devices could be mounted in the follower cylinder to actuate an engine valve directly or through other valve train elements without departing from the broader aspects of the invention.

In the DAHVL 52 of FIG. 3, the follower 54 includes a skirt or outer wall 55 integral with a central wall made up of a baffle 19 and cylinder 20 like those of the first embodiment. A head 56 closing the upper end of the outer wall is made of an alloy steel preferred for some engine applications and formed in a cup shape with downwardly extending portions joining with and forming part of the outer wall 55. The resulting annular space 58 is of slightly different configuration but is filled in similar manner with foam or other filler 59 which may be the same materials as in the first embodiment.

In FIG. 4, the DAHVL 60 is like FIG. 3 except that the baffle 62 portion of the central wall is formed as an open web of any suitable configuration. The baffle positions the cylinder 20 and its support is supplemented by the filler 63 which is injected or otherwise installed in the annular space 64 and may extend into the open portions of the web baffle 62.

In the DAHVL 65 of FIG. 5, the baffle is completely omitted and the cylinder 66 is solely supported by the filler 67 which fills the annular space 68 at least down to the lower edge of the cylinder 66. In this embodiment, the filler 67 must be sufficiently stiff and strong to maintain the cylinder 66 in its desired position in the follower.

Installation

Figure 6:
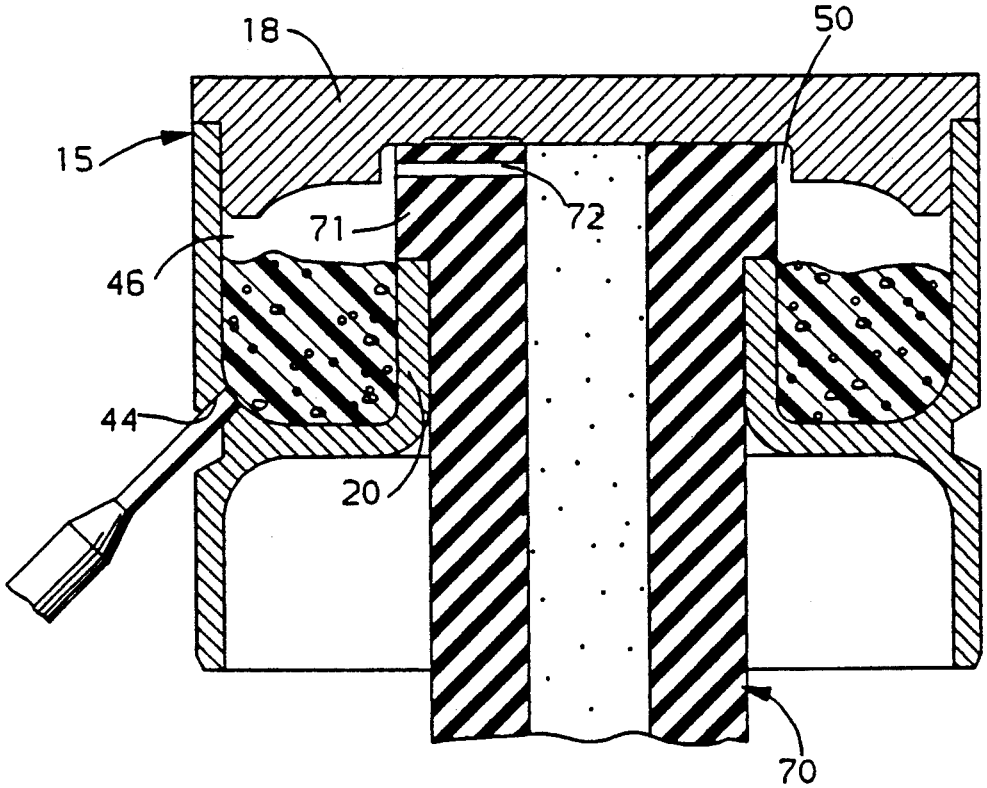
FIG. 6 is a cross-sectional view illustrating one method of injecting the filler in accordance with the invention.

Finally, FIG. 6 illustrates one possible manner of injecting a foam filler into the premachined follower 15 for a DAHVL like that of FIG. 1. A hollow rubber plug 70 is first forced into the cylinder 20. The plug 70 has an enlarged head 71 that extends up to the follower head 18 and outward into the annulus 50 with an air vent 72 extending from the top of the annulus 50 to the hollow center of the plug 70.

Thereafter, the prepared foam materials are injected into the annular space 46 preferably through the feed hole 44 as shown. With the follower body being maintained at a suitable temperature, the foam materials react to form the foam which fills the space 46, any excess being allowed to pass out through the vent 72 after the escaping air. After any required curing time, the rubber plug 70 is removed and the oil inlet passage 51 is formed as by drilling, hot wire melting or any other suitable manner. Thereafter, the HEA 24 may be installed to complete the assembly of the lifter.

In another method, the follower is inverted and a pin is placed through the feed hole 44 to form the inlet passage 51. Foam is then injected through a passage in the rubber plug such as 70 or another plug device or through a separate opening formed in the baffle 19. Such an opening could also serve to vent the foam filled annular space 46. Upon cooling, the foam forms a skin on its surface that helps protect it against abrasion or other deterioration during operation.

Obviously, any other suitable manner of making DAHVL's and other lifters according to the invention may also be utilized. For example, a preformed insert of filler material may be installed in the follower body before the head and outer wall or skirt portions are assembled together. Also, foam, epoxy or other materials may be injected through other openings or admitted in other ways.

Various means such as ribs or dimples on the interior of the outer wall 16 or a protrusion outward from the cylinder 20 could be used to prevent rotation or other movement of the foam or other filler material or means if the filler as installed is not otherwise fixed such as by adhesion. Such fixing of the filler is needed to assure that the inlet passage 51 in the filler remains aligned with the follower feed hole 44 so the flow of oil to the annulus 50 is not blocked. Holes or ribs in the baffle or cylinder into which the foam protrudes could act as inspection means for determining the completeness of foam filling of the annular space as well as preventing rotation of the filler material and reducing mass. FIG. 4 provides an illustration of such a concept where the filler 63 enters into the spaces between web elements of the baffle 62. Such an embodiment could easily be made by the alternative "inverted follower" method previously described with the spaces providing vents for the escape of air during foam formation.

Preferred Embodiment

Figure 7:
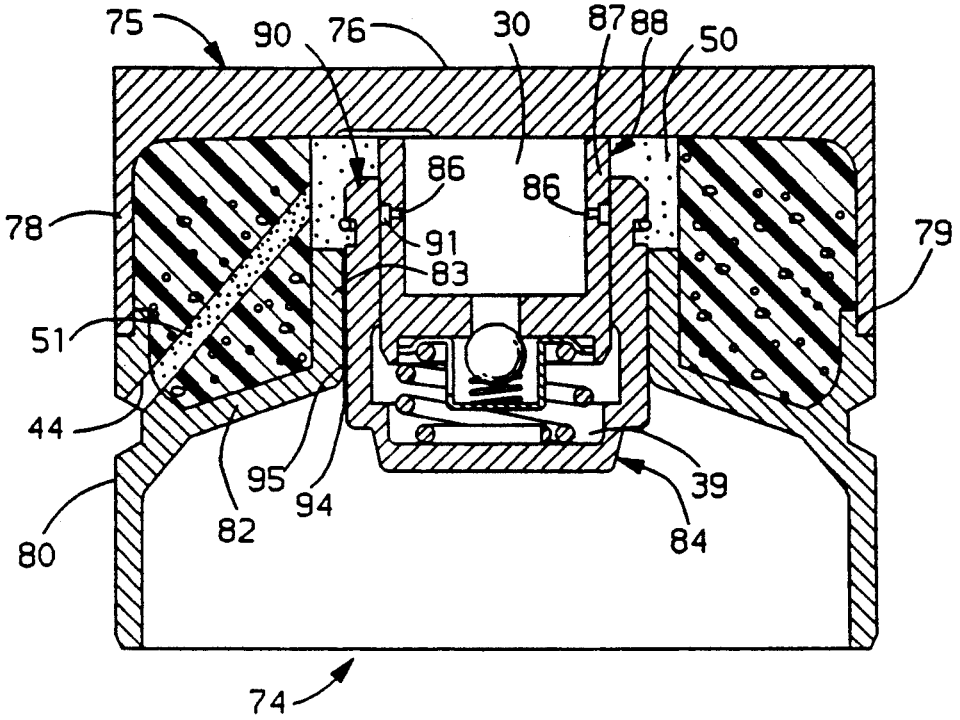
FIG. 7 is a cross-sectional view of another embodiment of foam filled DAHVL also including targeting, venting and recirculation features.

Further embodiments of the invention having additional forms and features are shown in FIGS. 7-10. In FIG. 7, the DAHVL 74 has a follower 75 which is a variation of that in FIG. 3. It differs in that the head 76 is integral with a further downwardly extending portion of the outer wall 78 and is received in a recessed portion 79 of the lower skirt 80 closely above an inwardly and upwardly extending baffle 82 that terminates in a cylinder 83 in which an HEA 84 is carried.

A preferred feature of the invention shown in this embodiment is recirculation means comprising at least one orifice 86 through the side wall 87 of the HEA plunger 88. More than one orifice may be provided all being preferably located within the HEA piston 90 during normal operation. An annular groove 91 is preferably provided around the plunger in alignment with the one or more orifices 86 but such a groove could be omitted or could optionally be located longitudinally adjacent the orifice(s) or in the piston inner wall near the normal position of the orifice 86.

The recirculation means collects oil escaping from the high pressure chamber 39 through the close clearances between the side walls of the piston 90 and the plunger 88, and recirculates the collected oil into the internal reservoir 30 instead of allowing it to escape into the annulus 50. This reduces the loss to the annulus 50 of relatively air-free oil from the high pressure chamber 39 and correspondingly reduces the need for makeup oil flow to the reservoir 30 from the annulus 50.

Another preferred feature of the invention shown in this embodiment is vent means in the form of a vent passage 94 of locally increased clearance between the piston 90 and cylinder 83 and extending axially therebetween to provide a path for air and oil flow from the annulus 50 to below the baffle 82 for return to the engine sump.

Figure 8:
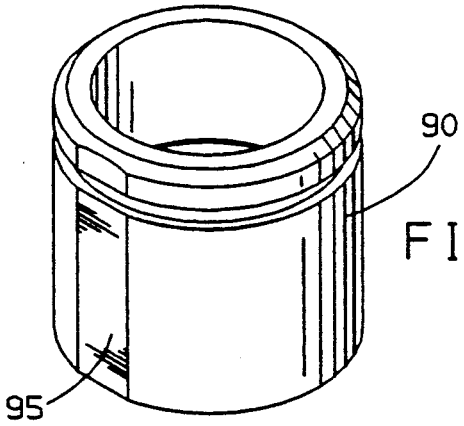
FIG. 8 is a pictorial view of a lifter piston with a flat for venting.

The vent passage may be formed by providing a shallow flat 95 on the outside of the piston 90 as is best shown in FIG. 8. Alternatively it could be formed by a straight groove 96 in the inner face of the cylinder 83*a* as shown in FIG. 9 or a spiral groove 97 in the cylinder 83*b* as in FIG. 10. The groove may be of any desired cross-sectional shape and of any suitable linear form including straight or spiral and could be on the piston instead of the cylinder. It must, however, be sized to allow a sufficient flow of air or air-containing oil to provide for removal of air in the valve lifter without causing an excessive flow of oil from the annulus such that increased oil pump capacity would be required. If desired, a more conventional vent passage through an orifice in the follower head 76 could be used in place of the novel vent means shown.

FIG. 11 shows an alternative to the preferred embodiment of FIG. 7 in which a DAHVL 98 has a follower 99 with a cup shaped outer shell 100 with integral head 102 and annular skirt 103 or outer wall portions. An inserted annular inverted U shaped baffle 104 has a lower outer edge fixed to an annular ridge 106 protruding from the central portion of the skirt inner wall opposite an external oil groove 107. The closed end 108 of the baffle engages the inner surface of the head 102 and an inner leg 110 extends downwardly forming a relieved upper portion 111 and a smaller diameter lower portion 112. The lower portion forms a cylinder, the inner surface 114 of which reciprocably carries an HEA 84 of the type shown in the FIG. 7 embodiment. However, other types of HEA's could be used as shown, for example, in FIG. 1. Preferably, a vent passage 94 as described in connection with FIGS. 7-9 is also provided in the FIG. 11 embodiment.

Oil is delivered to the HEA through a feed hole 115 that connects the groove 107 with a thin annulus 116. The annulus supplies a radial passage 118 formed by an indented portion of the baffle end 108 which allows oil to flow inward under the head to an annular space 119 around the plunger upper end. A recess 120 in the follower head 102 allows flow from the space 119 to the HEA reservoir 30 in the same manner as in the other described embodiments. The radial passage 118 is preferably aligned angularly with the recess 120 to provide some degree of preferential filling of the reservoir 30 by the aimed passage. If desired, the inner edge of the baffle end could be upwardly angled to improve the passage targeting.

To the extent that the weight of the inserted baffle 104 remains not greater than the integral baffle of a conventional follower, the reciprocating weight of the lifter can be reduced by the reduction of dead oil carried in the outer annulus. However, at present, the light weight foam filled embodiments are believed to provide the greatest potential for weight reduction.

As yet a further embodiment of the invention, it should be recognized that the any of the recirculation and vent features described could be used with other forms of followers than the foam filled and inverted U baffle embodiments described. In particular these features could equally well be provided in assemblies having conventional followers such as that shown in previously mentioned U.S. Pat. No. 4,745,888. Alternatively, a follower as in FIG. 7 but without the foam filler could be used. Such assemblies would, of course, not have the lighter weight advantage provided by the reduction of oil volume in the other embodiments.

Advantages

However made, valve lifters according to the invention may have some or all of the following advantages over the currently known lifters:

a. The reciprocating mass of the lifter may be reduced by an amount equal to the lower mass of the filler or baffle insert as compared to the oil it displaces from the annular space, such as 46, the amount depending, for example, upon the density of the filler material installed in the lifter;

b. The HEA guiding cylinder, such as 20, may be supplementally or even solely supported by the filler depending upon its strength;

c. Filling of the plunger reservoir with oil will be more rapid because there is no need to first fill the outer annular space, such as 46;

d. If the inlet passage 51 is aimed at the recess 47, this "targeting" will provide even quicker "preferential" filling of the reservoir;

e. Vent means from the follower oil chambers can increase the rate of air removal from the makeup oil;

f. Recirculation means having an orifice through the plunger can reduce the inflow of makeup oil to the HEA reservoir and thereby minimize the induction of air into the reservoir;

g. The combination of vent and recirculation means, reduced reciprocating oil volume and targeting of the incoming oil or any combination of these features together reduce the chance for operation of a DAHVL without full lash adjustment action;

While the invention has been described by reference to certain preferred embodiments, it should be understood that numerous changes could be made within the spirit and scope of the inventive concepts described. For example, the forms and materials suggested for the filler and for the follower body are not exclusive of other choices. Ceramic or powder metal as well as other materials may be suitable for the follower as well as cast iron or steel. Preformed hollow elements or other lightweight members could substitute for the foam or other fillers described. Accordingly it is intended that the invention not be limited to the disclosed embodiments, but that it have the full scope permitted by the language of the following claims.

What is claimed is:

1. A hydraulic valve lifter capable of forming at least a portion of an engine valve train between a cam and a valve, said lifter including a cup-like follower having a peripheral outer wall generally parallel with an axis of reciprocation and having closed and open ends, a cylinder spaced within the outer wall and having a cylinder surface parallel with the axis and spaced from the closed end, hydraulic means in the follower comprising a hollow piston closely guided in the cylinder surface and having a closed end facing away from the closed end of the follower, the closed ends of the follower and piston being adapted respectively for operative association in such valve train with the cam and valve, means including a passage for admitting hydraulic fluid through a first space between the cylinder and outer wall to a second space between the closed ends of the piston and follower, and filler means in said first space to block a substantial portion of said first space against the entry of hydraulic fluid to thereby limit the mass of the fluid contained in the first space, said filler means comprising a lightweight oil resistant foam.

2. A hydraulic valve lifter as in claim 1 wherein the filler means has a mass lower than that of an equivalent volume of hydraulic fluid occupying the portion of the first space blocked by said filler means.

3. A hydraulic valve lifter as in claim 2 wherein the cylinder is separate from the filler means.

4. A hydraulic valve lifter as in claim 1 wherein the filler means comprises a isocyanurate foam.

5. A hydraulic valve lifter as in claim 1 wherein the cylinder is separate from the filler means.

6. A hydraulic valve lifter including a cup-like follower having a peripheral outer wall generally parallel with an axis of reciprocation and having closed and open ends, a cylinder spaced within the outer wall and having a cylinder surface parallel with the axis, hydraulic means in the follower comprising a hollow piston closely guided in the cylinder surface and having a closed end facing away from the closed end of the follower, means for admitting hydraulic fluid through a first space between the cylinder and outer wall to a second space between the closed ends of the piston and follower, and filler means blocking a substantial portion of said first space against the entry of hydraulic fluid into said portion to thereby limit the mass of such fluid contained within the first space, said filler means comprising a lightweight oil resistant foam.

7. A hydraulic valve lifter as in claim 6 wherein the filler means has a mass less than that of an equivalent volume of hydraulic fluid occupying the portion of the first space blocked by said filler means.

8. A hydraulic valve lifter as in claim 6 wherein the filler means is an isocyanurate foam.

9. A hydraulic valve lifter as in claim 6 wherein the fluid admitting means includes a passage adjacent the filler means.

10. A hydraulic valve lifter as in claim 9 wherein the passage extends through the filler means.

11. A hydraulic valve lifter as in claim 6 wherein the cylinder is separate from the filler means.

12. A cup-like follower for a hydraulic valve lifter and comprising a peripheral outer wall generally parallel with an axis of reciprocation and having closed and open ends, a cylinder spaced within the outer wall and having a cylinder surface parallel with the axis, means for admitting hydraulic fluid through a first space between the cylinder and outer wall to a second space extending radially within the cylinder and adjacent the closed end of the follower, and filler means blocking a substantial portion of said first space against the entry of hydraulic fluid into said portion to thereby limit the mass of such fluid contained within the first space, said filler means comprising a lightweight oil resistant foam.

13. A cup-like follower as in claim 12 wherein the filler means has a mass less than that of an equivalent volume of hydraulic fluid occupying the portion of the first space blocked by said filler means.

14. A cup-like follower as in claim 12 wherein the filler means is an isocyanurate foam.

15. A cup-like follower as in claim 12 wherein the fluid admitting means includes a passage adjacent the filler means.

16. A cup-like follower as in claim 15 wherein the passage extends through the filler means.

17. A cup-like follower as in claim 12 wherein the cylinder is separate from the filler means.

* * * * *

UNITED STATES PATENT AND TRADEMARK OFFICE

CERTIFICATE OF CORRECTION

PATENT NO. : 5,245,958

DATED : September 21, 1993

INVENTOR(S) : John Joseph Krieg

It is certified that error appears in the above-identified patent and that said Letters Patent is hereby corrected as shown below:

On the title page, item (75) inventors, delete Lucille A.E. Gotham and Wayne S. Harris, both of Rochester, all of N.Y.

Signed and Sealed this

Fifth Day of April, 1994

Bruce Lehman

*Attest:*

BRUCE LEHMAN

*Attesting Officer*

*Commissioner of Patents and Trademarks*